United States Patent [19]

Paulson

[11] Patent Number: 4,905,793

[45] Date of Patent: Mar. 6, 1990

[54] LADDER BRACKET

[76] Inventor: Dennis R. Paulson, Star Rte. 1, Box 53A, Rochert, Minn. 56578

[21] Appl. No.: 412,674

[22] Filed: Sep. 26, 1989

[51] Int. Cl.[4] ..... E06C 7/08; E06C 7/10

[52] U.S. Cl. ..... 182/219; 182/215

[58] Field of Search ..... 182/217, 218, 219, 220, 182/194, 215; 248/210

[56] References Cited

U.S. PATENT DOCUMENTS

| | | | |
|---|---|---|---|
| 146,029 | 12/1873 | Smith | 182/219 |
| 285,605 | 9/1883 | Flora . | |
| 588,130 | 8/1897 | Cole . | |
| 727,047 | 5/1903 | Williamson . | |
| 727,259 | 5/1903 | Baker | 182/219 |
| 1,051,275 | 1/1913 | Schreiner | 182/219 |
| 1,126,625 | 1/1915 | Faulkner | 182/217 |
| 1,432,116 | 10/1922 | Martin | 182/194 |
| 1,475,078 | 11/1923 | Messacar . | |
| 1,595,952 | 8/1926 | Kramer et al. . | |
| 1,775,285 | 9/1930 | Little . | |
| 2,300,018 | 10/1942 | Schuck | 228/58 |
| 2,611,160 | 9/1952 | Hanesse | 20/92 |
| 2,885,132 | 5/1959 | Campbell | 228/58 |
| 3,533,203 | 10/1970 | Fischer | 182/219 |
| 4,024,929 | 5/1977 | Mintz | 182/151 |
| 4,060,150 | 11/1977 | Hughes | 182/151 |

FOREIGN PATENT DOCUMENTS

| | | | |
|---|---|---|---|
| 463633 | 7/1928 | Fed. Rep. of Germany | 182/217 |

*Primary Examiner*—Reinaldo P. Machado
*Attorney, Agent, or Firm*—Kinney & Lange

[57] ABSTRACT

A bracket device for use in assembling a ladder having a plurality of rungs and at least two side rails to which the rungs are attached includes a relatively flat band having a plurality of side rail engaging sections and a plurality of preformed rung engaging sections, the rung engaging sections and side rail engaging sections disposed alternatively along the band. The device along with the rungs are secured to the side rail members by suitable fasteners such as nails or screws.

12 Claims, 1 Drawing Sheet

10
12
14
16
18
20
22
2

12
16
18
20
22
24
26
28
30
32
34
36
38
40
42
44
46
48
50

LADDER BRACKET

BACKGROUND OF THE INVENTION

1. Field of the Invention.

The present invention is directed to ladders and methods of making ladders, and in particular, it is directed to a bracket which serves as a guide in making a ladder and which provides additional structural integrity to the ladder once the ladder is made.

2. Description of the Prior Art.

In the construction industry, ladders are often made at the construction sight. The ladders are used for transport between different elevations above ground or entry into and out of trenches below ground. On any given large project, as many as 100 ladders may be built.

One of the reasons for so many ladders being constructed on the job sight is the high cost of factory made step or extension ladders. In addition, due to the many uses of ladders at a construction sight, the ladders often have to be of different lengths. The lengths can vary from two feet to twenty feet. Furthermore, the ladders at a construction sight are subject to a high degree of use or damage and often need to be replaced or repaired.

Recently, OSHA regulations have been written specifying minimum requirements for ladders constructed on construction sights. Previous to the OSHA regulations, ladders were built using 2×4's as side rails with 1×4 wooden rungs that were nailed to the side rails with two or three nails. These types of ladders are now unacceptable at construction sights due to the OSHA regulations.

Some patents which describe ladder construction include the following:

| Inventor | U.S. Pat. No. |
|---|---|
| Flora | 285,605 |
| Cole | 588,130 |
| Williamson | 727,047 |
| Messacar | 1,475,078 |
| Kramer et al | 1,595,952 |
| Little | 1,775,285 |
| Shuck | 2,300,018 |
| Hanesse | 2,611,160 |
| Campbell | 2,885,132 |
| Mintz | 4,024,929 |
| Hughes | 4,060,150 |

The Shuck U.S. Pat. No. 2,300,018 describes a bracket with attaches ladder rungs to vertical members of a ladder. Each rung needs one bracket at each end of the rung to attach the rung to the vertical members, or two brackets per rung.

The Cole U.S. Pat. No. 588,130, the Williamson U.S. Pat. No. 727,047, the Messacar U.S. Pat. No. 1,475,078, the Little U.S. Pat. No. 1,775,285, and the Hanesse U.S. Pat. No. 2,611,160 also describe arrangements in which the end sections of the rungs of the ladders are attached to the side rails by individual brackets.

The Mintz U.S. Pat. No. 4,024,929 describes a portable ladder that is made of a plurality of similar interfitting rail units which are modular in nature to facilitate assembly and disassembly of a ladder of any desired height. A plurality of similar rung units interfit with and interlock upon the rail units at spaced intervals to form a complete ladder construction.

The Campbell U.S. Pat. No. 2,885,132 describes a ladder whose side rails are made of two longitudinal sections having a plurality of channels which when put together encircle rung ends. Layers of glass-reinforced plastic extend for the entire length of the side rail and encircle each rung end.

The Hughes U.S. Pat. No. 4,060,150 describes a ladder kit that includes elongated tubular side rail sections and rectangular frame sections. The frame sections fasten the side rail sections into coplanar pairs and form the rungs of the ladder.

The Flora U.S. Pat. No. 285,605 describes a ladder in which the side rails are made of two longitudinal sections. The rungs of the ladder fit into slots in the side rail sections. The slots encompass end sections of the rungs when the rail sections are joined together to form the side rails.

The Kramer et al U.S. Pat. No. 1,595,952 describes a ladder in which the rungs are attached to the side rails and are further supported by individual brackets disposed diagonally from the side rail to the rung.

SUMMARY OF THE INVENTION

The present invention includes a bracket device that selectively spaces the rungs of a ladder while providing further structural integrity to the ladder. In addition, ladders of various lengths may be made using the bracket device of the present invention.

The bracket device includes a relatively flat band having a plurality of side rail engaging sections and a plurality of preformed rung engaging sections with the rung engaging sections and the side rail engaging sections being disposed alternatively along the band.

DETAILED DESCRIPTION OF THE PREFERRED EMBODIMENTS

Figure 1:
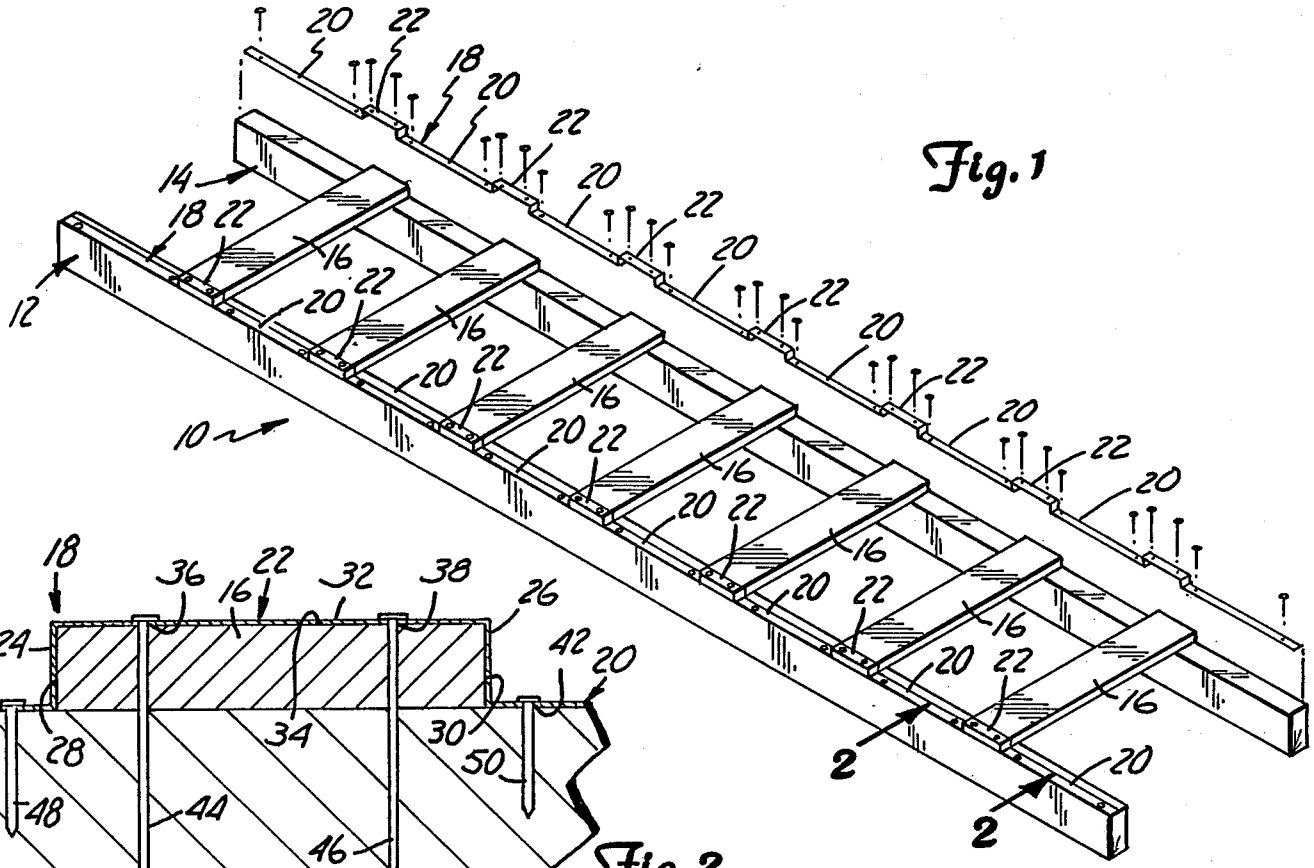
FIG. 1 includes a perspective view of the present invention.

A ladder of the present invention is generally indicated at 10 in FIG. 1. The ladder 10 includes left and right side rail members 12 and 14 A plurality of rungs 16 are secured to the side rail members using a bracket device 18 of the present invention.

The bracket device 18 is used to construct a ladder at a construction sight or anywhere else a ladder is needed. The device 18 automatically and selectively spaces ladder rungs as the ladder is being built. In addition, the bracket device of the present invention aids in securing rungs to the side rails and provides additional structural integrity to the ladder, once built. Furthermore, the bracket device 18 of the present invention may be cut so that ladders of any desired length can be built.

The bracket device 18 is preferably made of a narrow band or strip of metal. Alternatively, the device 18 could be made of plastic.

The bracket device 18 includes a plurality of side rail engaging sections 20 and a plurality of rung engaging sections 22. The rung engaging sections and the side rail engaging sections are disposed alternatively along the band 18.

Figure 2:
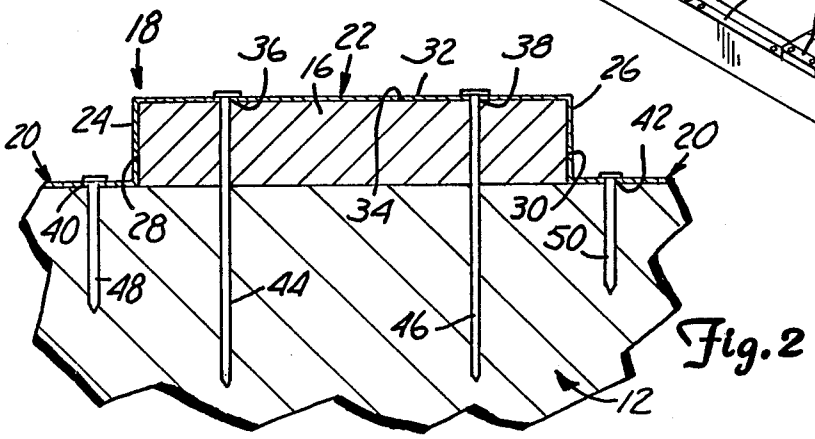
FIG. 2 is a sectional view taken along the line 2—2 in FIG. 1.

As best illustrated in FIG. 2, the rung engaging section is configured to conform to a section of the rung 16 that is adjacent the side rail member 12. In the embodiment illustrated in FIG. 2, the rung 16 is a section of standard 1×4 planking whose actual dimensions are $\frac{3}{4}$ inch by $3\frac{5}{8}$ inch. The rung engaging section 22 includes side wall engaging sections 24 and 26 that are disposed adjacent side surfaces 28 and 30 of the rung 16, respectively, and top surface engaging section 32 disposed adjacent the top surface 34 of the rung 16. It will be understood that rung engaging sections of different configurations are includable within the scope of the present invention.

The bracket device 18, when made of metal, is of a thickness readily formed by a stamping process. In one working example, the device is 1 inch wide and is made of 20 gage metal.

To secure the rung 16 to the side rail members 12 and 14 and to aid in making the ladder of the present invention, the bracket device 18 includes preferably two apertures 36 and 38. Adjacent the rung engaging section, the side rail engaging section also includes apertures 40 and 42. Generally, nails 44 and 46 are passed through the apertures 36 and 38 respectively and through the rungs 16 into the side rail member 12. Likewise, nails 48 and 50 are passed through the apertures 40 and 42, respectively, to secure the side rail engaging sections to the side rail. It will be understood, that other types of fasteners, such as screws, can also be inserted through the apertures and the rung engaging section and the side rail engaging section. Furthermore, if the bracket device 18 is sufficiently thin, nails or screws may be passed through the band without preformed apertures being needed.

The length of the nails or screws is such that the nails or screws enter the side rail member a sufficient distance to secure the rung 16 and the bracket to the side rail member. In one working embodiment, the side rail member is a standard 2×4 whose actual dimensions are $1\frac{1}{2}$ inches by $3\frac{1}{2}$ inches and an 8*d* nail is sufficient to secure a 1×4 rung to the side rail member without extending out of the $3\frac{1}{2}$ inch depth of the 2×4.

The bracket device !8 can be produced in any desired length, but is preferably produced in a few standard lengths such as 10 or 20 feet. If a length other than the standard leg is desirable, the bracket may then be cut to the desired length. In addition, ladder lengths longer than the length of the bracket can also be made by overlapping end portions of two bracket devices of the present invention.

To make the ladder of the present invention, two sides rail members are positioned approximately parallel with respect to each other and set apart a distance approximately equal to the length of the rung 16. A bracket device 18 is placed on the narrower surface of each side rail member. In the case of a 2×4, the bracket is placed on the $1\frac{1}{2}$ inch surface. Initially, one end of each bracket is secured to the 2×4 by a nail. To align the rung engaging sections, it is preferred that the ends of the bracket are aligned with the ends of the 2×4 which automatically aligns the rung engaging sections of the bracket devices.

After the bracket devices are initially secured, the rungs 16 are positioned between both bracket devices 18 and the two side rail members 12 and 14. The rung members are then secured by hammering nails through the apertures in the rung engaging section and the side rail engaging sections or by driving screws instead of nails through those sections.

Alternatively, the rungs !6 may be positioned within the rung engaging sections in a progressive manner. For example, a first rung may be positioned in a first pair of rung engaging sections and secured. A second rung is then placed in the next rung engaging sections and secured thereto, and so on.

The bracket device 18 is made of a material that is somewhat flexible such that the device 18 may be lifted after being initially secured to the side rail members so that rungs are positionable between the bracket device 18 and the side rail members. However, the bracket device 18 should have sufficient rigidness to provide additional support and structural integrity to the ladder, once built.

Although the present invention has been described with reference to preferred embodiments, workers skilled in the art will recognize that changes may be made in form and detail without departing from the spirit and scope of the invention.

What is claimed is:

1. A bracket device for use in assembling a ladder having a plurality of rungs and at least two side rails to which the rungs are attached, the device comprising:

a relatively flat band having a plurality of side rail engaging sections and a plurality of rung engaging sections, the rung engaging sections and side rail engaging sections being positioned alternatively along the band wherein the rung engaging sections are preformed to conform to outer surfaces of the rungs.

2. The bracket device of claim and further including:

means for attaching the side rail engaging sections to the side rail.

3. The device of claim 2 wherein the means for attaching the side rail engaging sections include apertures disposed within the side rail engaging sections.

4. The device of claim 1 and further including means for attaching the rung engaging sections to the rungs and to the side rails.

5. The device of claim 4 wherein the means for attaching the rung engaging sections to the rungs and to the side rails include apertures disposed within the rung engaging sections.

6. The device of claim 1 wherein the band is a continuous metal band.

7. A ladder comprising:

at least two side rails;

a plurality of rungs selectively spaced from each other secured to the side rails;

first and second bracket means, each bracket means including a band having side rail engaging sections and rung engaging sections and means for attaching the side rail engaging sections to the side rails, the rung engaging sections and side rail engaging sections being positioned alternatively along the band wherein the rung engaging sections are preformed to conform to outer surfaces of the rungs, and wherein the rung engaging sections of the first and second bracket means selectively space the rungs along the two side rails with the rungs being disposed between the side rails and the rung engaging sections; and fastening means extending through the bracket means and to the side rails for securing the rungs to the side rails.

8. The ladder of claim 7 wherein the fastening means extend through the side rail engaging sections.

9. The ladder of claim 7 wherein the fastening means extend through the rung engaging sections.

10. The ladder of claim 7 wherein the band is a continuous metal band.

11. A method of making a ladder comprising:

providing at least two side rails and a plurality of planks for rungs;

providing at least two brackets, each bracket containing a plurality of side rail engaging sections, and preformed rung engaging sections with the rung engaging sections disposed between side rail engaging sections;

positioning the first and second brackets along the side rails such that the rung engaging sections of one bracket are aligned with the rung engaging sections of the other bracket;

attaching an end of each bracket to the respective side rail with a fastener;

positioning the rungs between the rung engaging sections and the side rails; and securing the brackets with fasteners to the side rails.

12. The method of claim 11 wherein each bracket is a continuous band extending along the length of the respective side rail.

* * * * *

UNITED STATES PATENT AND TRADEMARK OFFICE

CERTIFICATE OF CORRECTION

PATENT NO. : 4,905,793

DATED : March 6, 1990

INVENTOR(S) : Dennis R. Paulson

It is certified that error appears in the above-identified patent and that said Letters Patent is hereby corrected as shown below:

Column 4, line 28, delete "claim" and insert --claim 1--.

Signed and Sealed this

Third Day of July, 1990

*Attest:*

HARRY F. MANBECK, JR.

*Attesting Officer*

*Commissioner of Patents and Trademarks*